US005496200A

United States Patent [19]

Yang et al.

[11] Patent Number: 5,496,200

[45] Date of Patent: Mar. 5, 1996

[54] SEALED VACUUM ELECTRONIC DEVICES

[75] Inventors: Ming-Tzong Yang, Hsin Chu; Hong-Tsz Pan, Chang-hua, both of Taiwan

[73] Assignee: United Microelectronics Corporation, Hsinchu, Taiwan

[21] Appl. No.: 305,560

[22] Filed: Sep. 14, 1994

[51] Int. Cl.[6] ..... H01J 1/30; H01J 9/02

[52] U.S. Cl. ..... 445/25; 445/50; 313/309; 313/336

[58] Field of Search ..... 445/24, 25, 50; 313/309, 336

[56] References Cited

U.S. PATENT DOCUMENTS

| | | | |
|---|---|---|---|
| 3,789,471 | 2/1974 | Spindt et al. | 445/50 |
| 3,970,887 | 7/1976 | Smith et al. | 445/50 |
| 3,998,678 | 12/1976 | Fukase et al. | 427/77 |
| 5,055,077 | 10/1991 | Kane | 445/24 |
| 5,249,340 | 10/1993 | Kane et al. | 445/50 |

FOREIGN PATENT DOCUMENTS

| | | | |
|---|---|---|---|
| 91/12624 | 8/1991 | WIPO | 313/336 |

*Primary Examiner*—Samuel M. Heinrich
*Assistant Examiner*—Jeffrey T. Knapp
*Attorney, Agent, or Firm*—George O. Saile; Steve Ackerman

[57] ABSTRACT

The method is for manufacturing sealed vacuum field emission devices. A field EMITTER TIP is formed on a silicon substrate. A first dielectric layer is formed over the field EMITTER TIP and over the silicon substrate. The first dielectric layer is planarized to provide a smooth top surface co-planar with the top of the field EMITTER TIP. A grid metal layer is formed over the first dielectric layer. A second dielectric layer is formed over the grid metal layer. The second dielectric layer is patterned to provide an opening, vertically located over the field emission device, to the grid metal layer. The grid metal layer is patterned in the area defined by the opening. The first dielectric layer is removed in the region defined by the opening, and also a portion of the first dielectric layer under the grid metal layer. The upper portion of the opening is narrowed. A second metal layer is formed over the second dielectric layer and over the opening, in a vacuum environment, such that the field EMITTER TIP is in a sealed vacuum.

23 Claims, 4 Drawing Sheets

SEALED VACUUM ELECTRONIC DEVICES

BACKGROUND OF THE INVENTION (1) Field of the Invention

The invention relates to a process for fabricating a semiconductor field emission device, and more particularly to a method for manufacturing such a device in a sealed vacuum.

(2) Description of the Related Art

Field emission devices have received increased attention in recent years, as integrated circuit manufacturing techniques have allowed for further miniaturization and, subsequently, new applications. Typically, one or many of a small, conical conductive emitter tip are formed on a conductive cathode. A second conductive surface, or grid, is formed in close proximity and parallel to the cathode surface, with the two surfaces separated by a dielectric layer. Apertures are formed in the grid layer and dielectric in the area of the emitter tips, with the grid opening surrounding the upper part of the emitter. An anode is mounted opposite the grid and a vacuum formed in the region between the emission device and anode, to allow for electron emission. When a positive bias is applied at the grid with respect to the cathode, electrons are emitted from the small emitter tip, with the current generated depending on the operating voltage, the sharpness of the tip and the emitter material work function.

A sealed vacuum electronic device is described in IEDM 91'8.3.1., but is difficult to manufacture. There are several methods for fabricating field emission devices such as in U.S. Pat. No. 4,857,799 to C. A. Spindt et al, and U.S. Pat. No. 4,908,539 to Meyer. Spindt describes the manufacturing of field emission devices for matrix-addressed flat panel displays, and resolves one earlier problem of screen distortion due to the vacuum by providing a support structure between the grid and anode at intermittent locations across the display surface. Details on how the vacuum is created are not provided, however.

SUMMARY OF THE INVENTION

It is a principal object of the invention to provide a simple and very manufacturable method for making sealed vacuum field emission devices.

Another object is the formation of a sealed vacuum field emission device with a vertical structure.

These objects are achieved by first forming a field emission device on a silicon substrate. A first dielectric layer is formed over the field emission device and over the silicon substrate. The first dielectric layer is planarized to provide a smooth top surface co-planar with the top of the field emission device. A grid metal layer is formed over the first dielectric layer. A second dielectric layer is formed over the grid metal layer. The second dielectric layer is patterned to provide an opening, vertically located over the field emission device, to the grid metal layer. The grid metal layer is patterned in the area defined by the opening. The first dielectric layer is removed in the region defined by the opening, and also a portion of the first dielectric layer under the grid metal layer. The upper portion of the opening is narrowed. A second metal layer is formed over the second dielectric layer and over the opening, in a vacuum environment, such that the field emission device is in a sealed vacuum.

DESCRIPTION OF THE PREFERRED EMBODIMENTS

Figure 1:
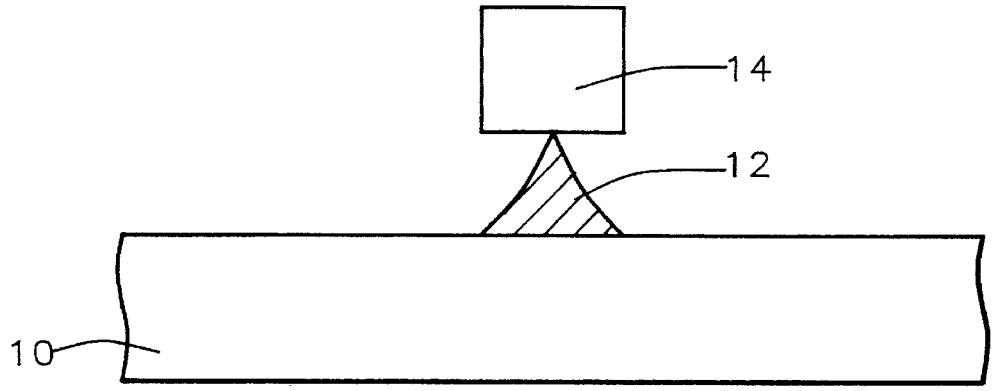
FIGS. 1 to 6 are cross-sectional representations of a first method of the invention for forming sealed vacuum field emission devices.

Referring now to FIG. 1, the field emission device formation is illustrated. Shown is only a single field emitter being formed, but it will be understood by those skilled in the art that the invention can be achieved simultaneously forming thousands of these emitters on a single silicon substrate 10. An emitter layer 12 is deposited and is formed silicon or a refractory metal, such as tungsten (W), cobalt (Co), titanium (Ti) or tantalum (Ta) and is deposited by sputtering or CVD (Chemical Vapor Deposition), to a thickness of between about 2000 and 50,000 Angstroms. A photoresist layer 14 is formed and patterned by conventional lithography to define a mask for the emitter tip. An etch is then performed to create the conical tip shape shown in FIG. 1. This etch may be by KOH (potassium hydroxide) wet etching, or by a dry isotropic etch. A dry etch of silicon could be with $CF_4$ (carbon tetrafluoride), $C_2F_6$, $SF_6$ (sulfur hexafluoride), $Cl_2$ (chlorine) or HBr (hydrogen bromide). A metal dry etch could be performed with $BCl_3$ (boron trichloride), $CCl_xF_y$, or $C_2F_6$. The resist 14 is then stripped and, where the emission device is formed of silicon, doped by diffusion with $POCl_3$ (phosphorus oxychloride) or by ion implantation at a concentration of between about 1 E 18 (i.e. $1\times10^{18}$) and 1 E 21 atoms/cm.$^3$.

Figure 2:
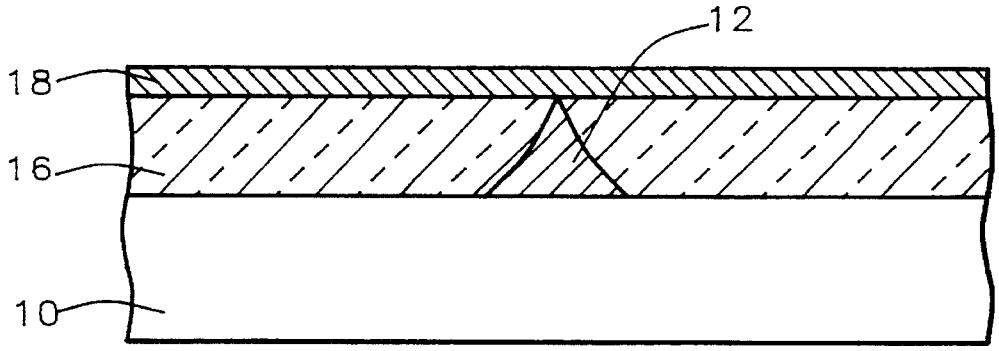

Referring now to FIG. 2, a dielectric layer 16 of silicon nitride ($Si_3N_4$) is conformally deposited over the substrate and emitter tip structure, by LPCVD (Low Pressure Chemical Vapor Deposition), to a thickness of between about 1000 and 10,000 Angstroms. This layer is planarized by SOG (Spin-on-Glass) etch back, as is known in the art.

A conducting grid metal layer 18 is now deposited over the dielectric layer 16. This layer may be composed of a refractory metal, preferably tungsten (W), and is deposited by LPCVD, APCVD (Atmospheric Pressure CVD) or PECVD (Plasma-Enhanced CVD) to a thickness of between about 100 and 5000 Angstroms.

Figure 3:
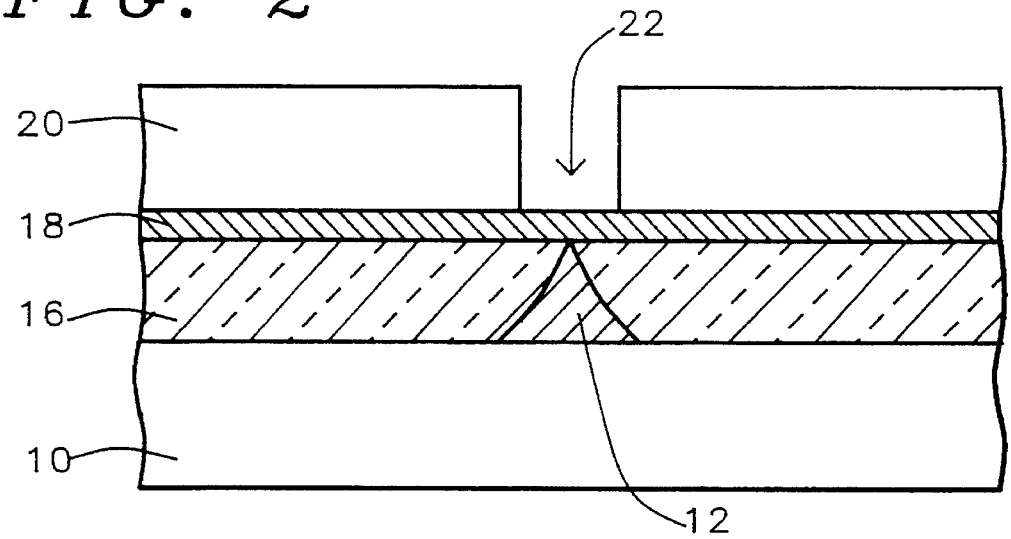

With reference to FIG. 3, a second dielectric layer 20 is now deposited on grid metal layer 18. This second dielectric is formed of borophosphosilicate glass (BPSG) or highly-doped phosphosilicate glass (PSG) having a dopant concentration of between about 1 E 18 and 1 E 22 atoms/cm.$^3$. This layer is deposited by LPCVD, APCVD or PECVD to a thickness of between about 1000 and 20,000 Angstroms. This layer is then patterned by conventional lithography and anistropic etching to form an opening 22 which will define the hole in the grid metal layer 18, above the emission tip 12. This opening has a width of between about 0.3 and 5 micrometers.

Figure 4:
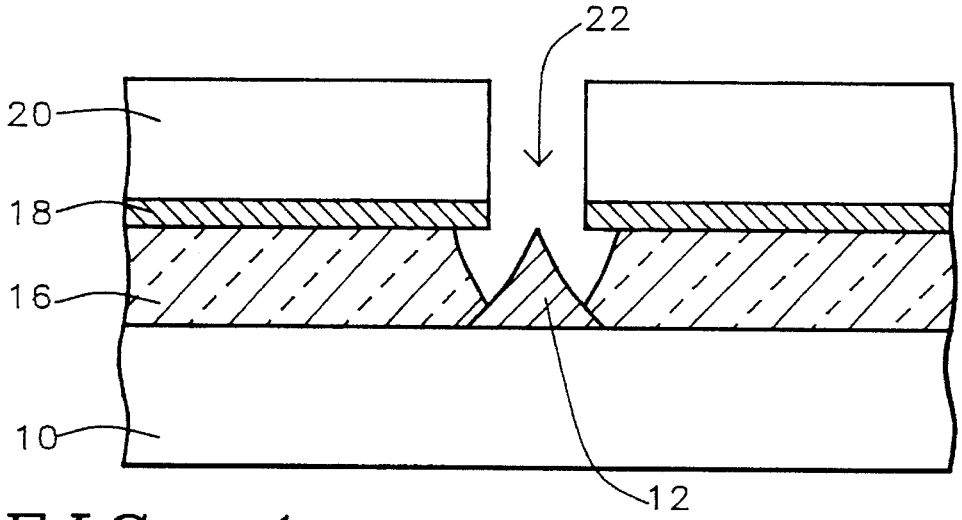

FIG. 4 indicates the result of etching of the grid metal layer 18 and the dielectric layer 16 under the opening 22. The grid metal layer 18 is etched by reactive ion etching (RIE) or electron cyclotron resonance (ECR) with $BCL_3$ or $Cl_2$, at a power of between about 200 and 8000 watts, for between about 30 seconds and 5 minutes, to a width defined by opening 22. A subsequent wet etch of silicon nitride 16 uses phosphoric acid ($H_3PO_4$) for between about 10 and 300 minutes to expose the tip of emitter 12 and remove silicon nitride around the top of the emitter and under the grid metal, as shown in FIG. 4.

Figure 5:
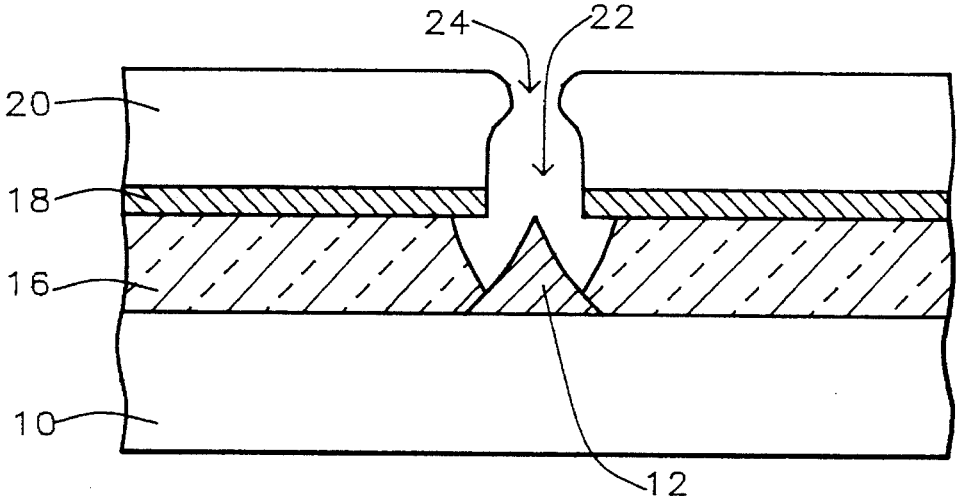

The dielectric layer 20, formed of BPSG or PSG, is now reflowed in order to form the narrowed opening 24 at the upper portion of opening 22, as shown in FIG. 5. This is accomplished by heating to a temperature of between about 700° and 1000° C. for between about 5 and 100 minutes. This reflow may also be performed in an RTP (Rapid Thermal Processing) chamber by heating to a temperature of between about 1000° and 1100° C. for between about 5 seconds and 10 minutes. Opening 24 has a width of between about 0.1 and 2 micrometers. This narrowed opening is necessary to prevent metal deposition deeply into opening 22 during the subsequent anode formation step.

Figure 6:
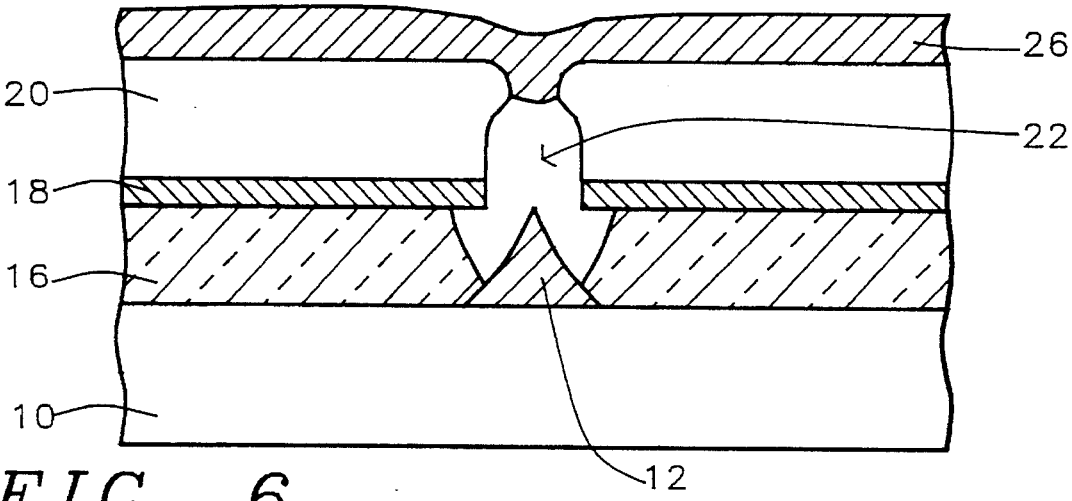

The final step is the critical step of the invention. Referring to FIG. 6, the anode 26 is formed and simultaneously a vacuum is formed in the region between the emitter 12 and anode 26, due to the nature of the deposition process used to form the anode. The anode is a metal such as Al (aluminum), AlSiCu (aluminum silicon copper) or AlSi, deposited by electron-beam evaporation, filament evaporation or sputtering in a vacuum below about 1 E–4 torr. All of these deposition processes utilize vacuum processes, such that when metal anode 26 completely encloses opening 22, the opening remains evacuated. The anode is formed to a thickness of between about 1000 and 20,000 Angstroms, and during deposition the upper portion of the opening in dielectric 20 is sufficiently narrow to prevent metal from forming on the emitter tip. The resultant vacuum has a pressure of less than about 1 E –4 torr.

Figure 7:
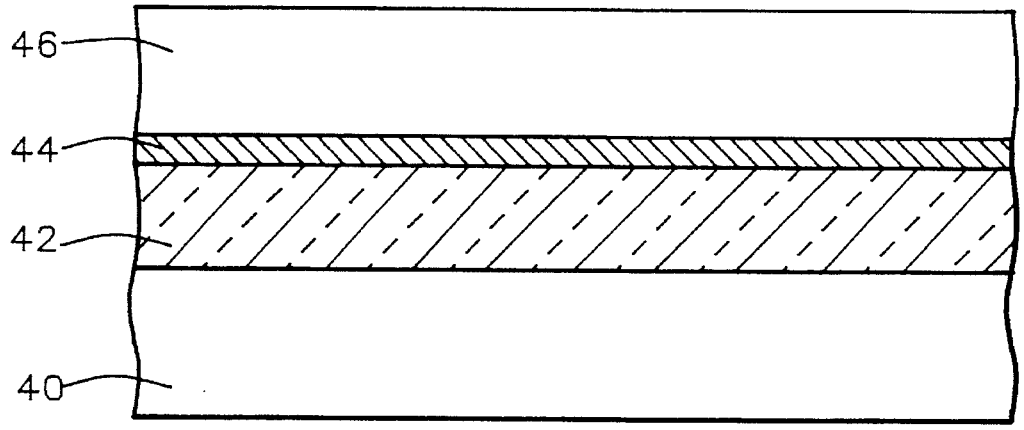
FIGS. 7 to 10 are cross-sectional representations of a second method of the invention for forming sealed vacuum field emission devices.

A second method of the invention is described with respect to FIGS. 7 to 10. In this method the emitter device is formed simultaneously with the anode rather than early in the process as in the first method. Referring now to FIG. 7, a first $Si_3N_4$ dielectric 42 is formed on silicon substrate 40 to a thickness of between about 1000 and 10,000 Angstroms. The grid metal 44 is subsequently formed over the dielectric 42. The nitride and grid metal layers are formed using the same processes and materials as in the first method, described above. Second dielectric 46 is formed over grid metal layer 44.

Figure 8:
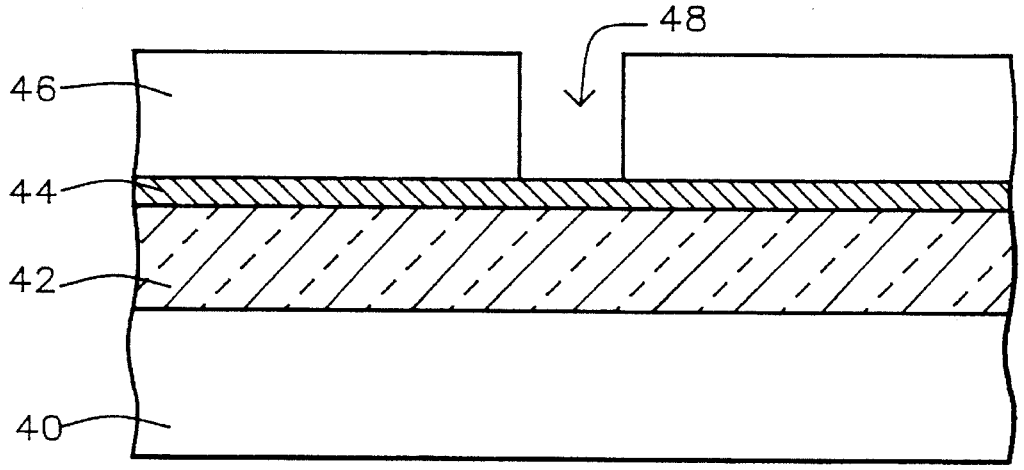
Figure 9:
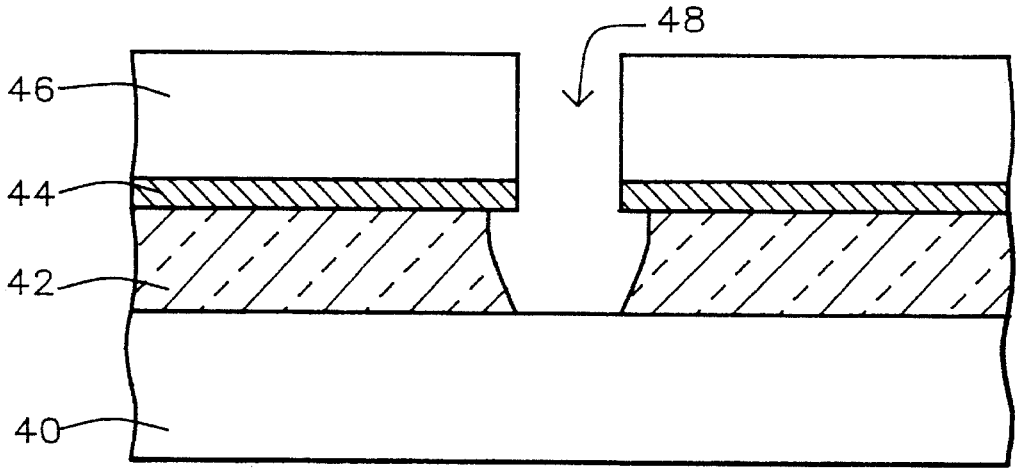

Referring now to FIG. 8, a grid hole 48 is formed in layer 46 as in the first method. Similarly, openings are formed in the grid layer 44 and in the first dielectric 42 by etching, also as detailed in the first method above and as shown in FIG. 9. Dielectric 46 is reflowed as in the first method, to narrow the top of opening 48, as shown in FIG. 10.

Figure 10:
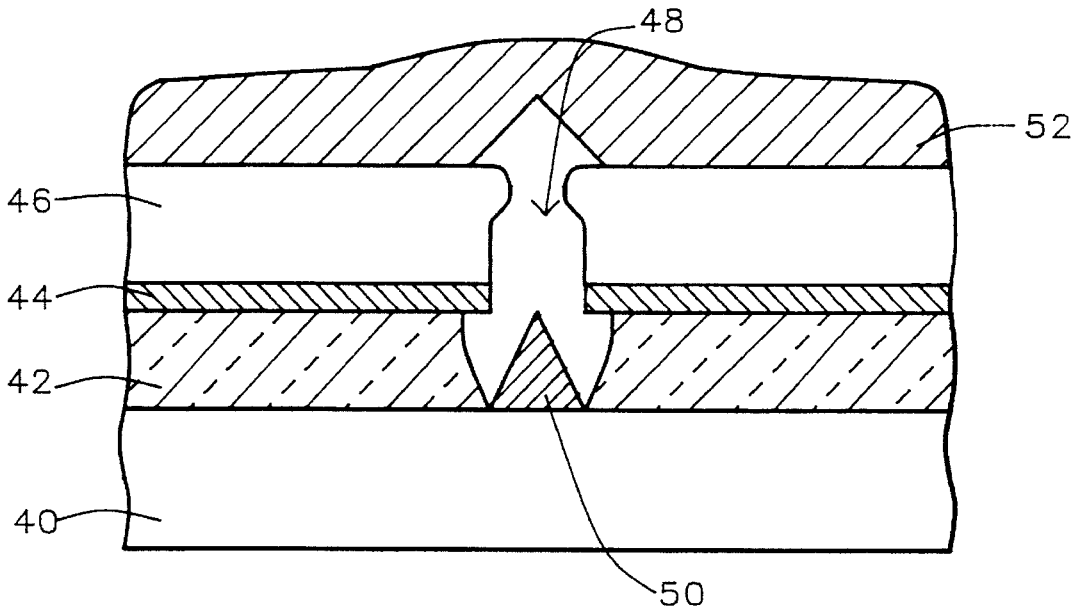

With reference to FIG. 10, the final step of the second method is described. Using sputtering, electron-beam evaporation or filament evaporation, a metal deposition takes place to form, simultaneously, emitter tip 50 and anode metal layer 52. As the tip is completed and comes to a point, the opening in the anode layer is closed off, and since the above deposition processes utilize a vacuum, a vacuum remains in opening 48 after completion of the device. The resulting emitter height is between about 1000 and 20,000 Angstroms, and the anode thickness is also between about 1000 and 20,000 Angstroms. The resultant vacuum has a pressure of less than about 1 E –4 torr.

While the invention has been particularly shown and described with reference to the preferred embodiments thereof, it will be understood by those skilled in the art that various changes in form and details may be made without departing from the spirit and scope of the invention.

What is claimed is:

1. A method of manufacturing a sealed vacuum field emission device, comprising the steps of:

forming a field emitter tip on a silicon substrate;

forming a first dielectric layer over said field emitter tip and over said silicon substrate;

planarizing said first dielectric layer to provide a smooth top surface of said first dielectric layer that is co-planar with the top of said field emitter tip;

forming a grid metal layer over said first dielectric layer;

forming a second dielectric layer over said grid metal layer;

patterning said second dielectric layer to provide an opening, vertically located over said field emission device, to said grid metal layer;

patterning said grid metal layer in area defined by said opening;

removing said first dielectric layer in the region defined by said opening and also a portion of said first dielectric layer under said grid metal layer;

narrowing the upper portion of said opening; and forming in a vacuum environment a second metal layer over said second dielectric layer and over said narrowed opening, whereby said field emitter tip is in a sealed vacuum.

2. The method of claim 1 wherein said sealed vacuum is at a pressure of less than about 1 E–4 torr.

3. The method of claim 1 wherein said second metal layer is formed by sputtering in said vacuum environment.

4. The method of claim 1 wherein said second dielectric layer is formed of borophosphosilicate glass, to a thickness of between about 1000 and 20,000 Angstroms.

5. The method of claim 1 wherein said second dielectric layer is formed of phosphosilicate glass, doped to a concentration of between about 1 E 18 and 1 E 22 atoms/cm.$^3$, and formed to a thickness of between about 1000 and 20,000 Angstroms.

6. The method of claim 1 wherein said narrowing the upper portion of said opening is accomplished by heating to a temperature of between about 700° and 1000° C., for between about 5 and 100 minutes, to reflow said second dielectric layer.

7. The method of claim 1 wherein said opening has a width of between about 0.3 and 5 micrometers.

8. The method of claim 1 wherein said narrowing the upper portion of said opening reduces the opening width to between about 0.1 and 2 micrometers.

9. The method of claim 1 wherein said grid metal layer is formed of a refractory metal to a thickness of between about 100 and 5000 Angstroms.

10. The method of claim 1 wherein said first dielectric layer is formed of silicon nitride having a thickness of between about 1000 and 10,000 Angstroms.

11. The method of claim 1 wherein said second metal layer is formed by evaporation in said vacuum environment.

12. The method of claim 11 wherein said evaporation is electron-beam evaporation.

13. The method of claim 11 wherein said evaporation is filament evaporation.

14. A method of manufacturing a sealed vacuum field emission device, comprising the steps of:

forming a first dielectric layer over a silicon substrate;

forming a grid metal layer over said first dielectric layer;

forming a second dielectric layer over said grid metal layer;

patterning said second dielectric layer to provide an opening to said grid metal layer;

patterning said grid metal layer in area define by said opening;

removing said first dielectric layer in a region defined by said opening and also a portion of said first dielectric layer under said grid metal layer;

narrowing the upper portion of said opening; and forming in a vacuum environment a second metal layer over said second dielectric layer and over said narrowed opening simultaneously forming a field emitter tip on said silicon substrate, thus forming a field emission device that is in a sealed vacuum.

15. The method of claim 14 wherein said sealed vacuum is at a pressure of less than about 1 E–4 torr.

16. The method of claim 14 wherein said second metal layer is formed by sputtering in said vacuum environment.

17. The method of claim 14 wherein said second metal layer is formed by evaporation is said vacuum environment.

18. The method of claim 17 wherein said evaporation is electron-beam evaporation.

19. The method of claim 17 wherein said evaporation is filament evaporation.

20. A method of forming a vacuum in a region between a field emission tip and a metal anode, comprising the steps of:

forming said field emission tip on a silicon substrate;

forming a first dielectric layer over said field emission tip and over said silicon substrate;

planarizing said first dielectric layer to provide a smooth top surface co-planar with the top of said field emission tip;

forming a grid metal layer over said first dielectric layer;

forming a second dielectric layer over said grid metal layer;

pattering said second dielectric layer to provide an opening, vertically located over said field emission tip, to said grid metal layer;

patterning said grid metal layer in area defined by said opening;

removing said first dielectric layer in the region defined by said opening and also a portion of said first dielectric layer under said grid metal layer;

narrowing the upper portion of said opening; and forming said vacuum by depositing in a vacuum environment a second metal layer over said second dielectric layer and over said narrowed opening.

21. The method of claim 20 wherein said second metal layer is formed by evaporation in said vacuum environment.

22. The method of claim 20 wherein said second metal layer is formed by sputtering in said vacuum environment.

23. The method of claim 20 wherein said vacuum is at a pressure of less than about 1 E–4 torr.

* * * * *